US005084196A

United States Patent [19]

Seiki

[11] Patent Number: 5,084,196

[45] Date of Patent: Jan. 28, 1992

[54] LUBRICATING OIL COMPOSITION FOR FLON ATMOSPHERE COMPRISING A POLYSILOXANE HAVING EPOXY STRUCTURE

[75] Inventor: Hiromichi Seiki, Ichihara, Japan

[73] Assignee: Idemitsu Kosan Company Limited, Tokyo, Japan

[21] Appl. No.: 415,236

[22] PCT Filed: Jan. 25, 1989

[86] PCT No.: PCT/JP89/00063

§ 371 Date: Sep. 8, 1989

§ 102(e) Date: Sep. 8, 1989

[87] PCT Pub. No.: WO89/07128

PCT Pub. Date: Aug. 10, 1989

[30] Foreign Application Priority Data

Jan. 29, 1988 [JP] Japan ..... 63-17333

[51] Int. Cl.[5] ..... C10M 155/02; C09K 5/00

[52] U.S. Cl. ..... 252/49.6; 252/68

[58] Field of Search ..... 252/49.6, 68

[56] References Cited

U.S. PATENT DOCUMENTS

| | | | |
|---|---|---|---|
| 3,219,624 | 11/1965 | Cohen | 252/49.6 |
| 3,887,487 | 6/1975 | Camp et al. | 252/49.6 |
| 4,185,140 | 1/1980 | Strella et al. | 252/49.6 |
| 4,787,991 | 11/1988 | Morozumi et al. | 252/49.6 |

*Primary Examiner*—Jacqueline V. Howard
*Assistant Examiner*—Jerry D. Johnson
*Attorney, Agent, or Firm*—Antonelli, Terry, Stout & Kraus

[57] ABSTRACT

There is disclosed a lubricating oil composition for a Flon atomsphere which comprises 100 parts by weight of a base oil having a kinematic viscosity at 40° C. of 5 to 500 cSt and 0.0001 to 1 part by weight of a polysiloxane having an epoxy structure and a kinematic viscosity at 25° C. of 1000 cSt or higher.

This lubricating oil composition has excellent high temperature stability and anti-foaming properties in the presence of various coolants such as Flon, etc., and can be effectively utilized as a refrigerator oil, a heat pump oil, etc.

9 Claims, No Drawings

LUBRICATING OIL COMPOSITION FOR FLON ATMOSPHERE COMPRISING A POLYSILOXANE HAVING EPOXY STRUCTURE

TECHNICAL FIELD

This invention relates to a lubricating oil composition for a Flon atmosphere, more specifically to a lubricating oil composition which has excellent stability in a Flon atmosphere as well as excellent anti-foaming properties.

BACKGROUND ART

Generally, for lubricating oil used as a refrigerator oil, a heat pump oil, etc., various properties are required, such as (1) suitable viscosity, (2) excellent low temperature characteristics (low pour point or low flock point, etc.), (3) good compatibility with a coolant, (4) excellent high temperature stability under a coolant atmosphere, (5) excellent lubricity, (6) excellent anti-foaming properties, and the like.

On the other hand, in recent years, the tendency of increasing high efficiency, a miniaturization and weight reduction have rapidly progressed in refrigerators, heat pumps, etc., and the reciprocating system in compressors has changed to the rotary system. Further, there is a tendency that the temperature of exhaust gas is rising due to loading of an inverter or recovery of exhaust heat by a heat pump. Therefore, it is strongly required of a refrigerator oil, etc. to have high temperature stability.

In a refrigerator or a heat pump, accompanying the change in load at starting or during operation of a compressor, the pressure in a crankcase rapidly reduces so that Flon as a coolant dissolved in an oil evaporates and foams to cause various problems. That is, when foaming is marked, the frothy oil is accompanied by coolant gas (Flon) to be absorbed into a cylinder of the compressor and the inside of the cylinder is temporarily flooded with a large amount of oil. As the result, there is a fear that a valve mechanism may be damaged according to a large impact force due to the liquid hammer phenomenon. In addition, since such a large amount of oils flow out, the inside of the compressor is lacking for oil so that it offers adverse effect to lubrication at the sliding portion of metals, etc. and there is a danger of seizure occuring.

From the situation as mentioned above, there has been a desire to provide excellent anti-foaming properties to lubricating oils to be used for refrigerators or heat pumps.

The present inventor has intensively studied to solve the problems of the above conventional refrigerator oils, etc., and to develop a lubricating oil with excellent stability and improved anti-foaming properties under a Flon atmosphere.

As a result, it has been found that the above problems can be solved by blending a high viscosity polysiloxane having an epoxy structure with a base oil of a lubricating oil within a predetermined range. The present invention has completed based on such a finding.

An object of the present invention is to provide a lubricating oil composition with excellent stability under a Flon atmosphere.

Also, another object of the present invention is to provide a lubricating oil composition with excellent anti-foaming properties.

DISCLOSURE OF INVENTION

That is, the present invention is to provide a lubricating oil composition for a Flon atmosphere which comprises 100 parts by weight of a base oil having a kinematic viscosity at 40° C. of 5 to 500 cSt and 0.0001 to 1 part by weight of a polysiloxane having an epoxy structure and a kinematic viscosity at 25° C. of 1000 cSt or higher.

In the lubricating oil composition of the present invention, as a base oil (a base oil of the lubricating oil), a mineral oil or a synthetic oil can be used singly or in combination. Also, regarding the properties of the base oil, in general, a kinematic viscosity at 40° C. may be 5 to 500 cSt, preferably 10 to 300 cSt, and there is no particular limitation concerning the other properties. Here, if the kinematic viscosity is less than 5 cSt, such problems occur that an amount of oil consumption by evaporation becomes large, that an amount of circulating oil increases, and that the sealing properties are poor. As representative examples of mineral oils used as the base oil, there can be mentioned a distillate oil obtained by atmospheric distillation of paraffin base crude oils, intermediate base crude oils or naphthene base crude oils, or by vacuum distillating the residual oil from the atmospheric distillation, or refined oils obtained by purifying the above according to the ordinary method, that is, solvent-refined oil, hydrogenated oil, dewaxed oil and clay-treated oil. As the dewaxed oil, a deep dewaxed oil obtained by highly dewaxing treatment such as hydrogenation dewaxing treatment using a zeolite catalyst, etc. is particularly preferred.

Also, the synthetic oils are not particularly limited, various kinds of materials can be used, and they includes, for example, alkylbenzene (straight-chain alkylbenzene, branched alkylbenzene), alkyldiphenyl, poly-α-olefin, polybutene, esters (hindered ester, dibasic acid ester, complex ester, phosphate), polyethers (polyphenylether, polyglycol ether), silicone oil, etc.

Next, in the lubricating oil composition of the present invention, it is necessary to blend a polysiloxane having an epoxy structure with the above base oil. The polysiloxane having the epoxy structure can be any material so long as it has a kinematic viscosity at 25° C. of 1000 cSt or higher, and various kinds thereof can be mentioned, but generally the compound represented by the following formula can be mentioned.

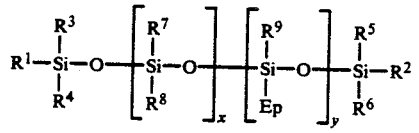

(I)

(wherein $R^1$ to $R^6$ each represents an alkyl group having 1 to 20 carbon atoms, a cycloalkyl group having 6 to 30 carbon atoms, an alkylaryl group having 6 to 30 carbon atoms or an alkoxy group having 1 to 20 carbon atoms; $R^7$ and $R^8$ each represents an alkyl group having 1 to 20 carbon atoms, an alkylaryl group having,6 to 30 carbon atoms or a cycloalkyl group having 6 to 30 carbon atoms; $R^9$ represents an alkyl group.having 1 to 20 carbon atoms, an alkylaryl group having 6 to 30 carbon atoms or a group having an epoxy structure. Also, Ep represents a group having an epoxy structure; and x and y are integers satisfying $x \geqq 0$, $y > 0$ and $x+y=50$ to 2000.)

In the above formula (I), that having a form of the block copolymer is mentioned for convenience, but it may take various forms such as a random copolymer, a graft copolymer, an alternate copolymer, etc. Here, Ep represents a group having an epoxy structure, more specifically, it can include a glycidoxymethyl group, a β-glycidoxyethyl group, a γ-glycidoxypropyl group, a δ-glycidoxybutyl group, a glycidoxyoctyl group, a β-(3,4-epoxycyclohexyl)ethyl group, a β-(3,4-epoxyphenyl)ethyl group, etc. Further, $R^1$ to $R^6$ each represents the aforesaid substituents, but particularly, a methyl group is preferred for $R^1$ and $R^2$, and a methyl group or a methoxy group is preferred for $R^3$ to $R^6$. Regarding $R^7$ to $R^9$, each represents the aforesaid substituents, but a methyl group is preferred for them, respectively. Also, regarding x and y, they can be integers satisfying the aforesaid formula, but $x+y=100$ to 1000 is preferred, and yet $y/(x+y)=0.01$ to 0.60, particularly $y/(x+y)=0.02$ to 0.50 is preferred.

The polysiloxane having an epoxy structure to be used in the lubricating oil composition of the present invention can be those represented by the above formula, and those having a kinematic viscosity at 25° C. of 1000 cSt or more, particularly 2500 or more, and an epoxy value of 0.01 to 0.5 gram equivalent/100 g, particularly 0.02 to 0.4 gram equivalent/100 g are preferred. When the kinematic viscosity is too small or the epoxy value is too large, anti-foaming properties decrease, and when the epoxy value is too small, stability is lowered.

In the lubricating oil composition of the present invention, the above polysiloxane having the epoxy structure is blended in an amount of 0.0001 to 1 part by weight, preferably 0.001 to 0.1 part by weight based on 100 parts by weight of the above base oil. Here, if the blended ratio of the polysiloxane having the epoxy structure is too small, anti-foaming properties desired do not develop sufficiently, and if it is too large, solubility is lowered whereby various hindrances result.

The lubricating oil composition of the present invention comprises the aforesaid base oil and polysiloxane having epoxy structure as the main components, and if necessary, various additives such as antioxidants, extreme pressure agents, oiliness agents, copper deactivators, etc. can also be blended.

Here, as the antioxidants, there may be phenol type antioxidants such as 2,6-di-t-butyl-p-cresol, 2,6-di-t-butyl-p-ethylphenol, 4,4'-methylenebis(2,6-di-t-butylphenol), etc.; and amine type antioxidants such as phenyl-α-naphthylamine, octylated-phenyl-α-naphthylamine, mono-octylated diphenylamine, di-octylated diphenylamine, etc.

Also, as extreme pressure agents, there can be mentioned phosphorus type extreme pressure agents and sulfur type extreme pressure agents, and among these, the phosphorus type extreme pressure agents can be classified into phosphate type (triphenyl phosphate, tricresyl phosphate, tri(isopropylphenyl) phosphate, tributylphosphate, trioctylphosphate, triphenyl thiophosphate, tricresyl thiophosphate, etc.) and phosphite type (triphenyl phosphite, tricresyl phosphite, tri(nonylphenyl)phosphite, trilauryl phosphite, tristearyl phosphite, trilauryl thiophosphite, etc.). Also, specific examples of the sulfur type extreme pressure agents include di-laurylthiodipropionate, ditridecylthiodipropionate, distearylthiodipropionate, thiophen, benzothiophen, dodecylsulfide, stearylmercaptane, etc.

Further, as the oiliness agents, there can be included di(2-ethylhexyl)sebacate, di(2-ethylhexyl)azerate, etc. and the copper deactivators include benzotriazole, methylbenzotriazole, dimethylbenzotriazole, mercaptobenzothiazole, etc.

Next, the present invention will be described in more detail by referring to Examples and Comparative examples.

EXAMPLES 1 TO 5 AND COMPARATIVE EXAMPLES 1 TO 6

Lubricating oil compositions were prepared by blending polysiloxane having the epoxy structure, etc. as shown in Table 2 to the base oil shown in Table 1 in a predetermined ratio. Regarding the resulting lubricating oil compositions, the shield tube test and the foaming property test were carried out. The results are shown in Table 3.

The shield tube test was carried out as shown below. That is, 4 ml of a sample oil was injected with an injector into a pressure-resistant ampoule made of a glass having an inner content of 10 ml and a steel, copper and aluminum wires inserted therein, and degassing treatment was carried out. While cooling it with liquid nitrogen, 2 g of dichlorodifluoromethane as a coolant was introduced therein and the ampoule was sealed with a burner. This sealed ampoule was allowed to stand in an oil bath at 175° C. for 480 hours. After completion of the test, the ampoule was cooled with liquid nitrogen and opened, and the contents from the opened edge were absorbed with about 100 ml of distilled water. Then, the amount of hydrochloric acid formed was calculated by titrating with 0.1N potassium hydroxide solution and the change in appearance of the oil was observed.

Also, the foaming test was carried out according to JIS K-2518.

TABLE 1

| Characteristic Kinds | Kinematic viscosity at 40° C. (cSt) | Kinematic viscosity at 100° C. (cSt) | Viscosity index |
|---|---|---|---|
| Mineral oil (deep dewaxed oil) | 36.60 | 5.648 | 89 |
| Polyglycol ether | 32.39 | 6.609 | 165 |

TABLE 2

| | Kinematic viscosity at 25° C. (cSt) | Epoxy value (gram equivalent/100 g) |
|---|---|---|
| Epoxy-substituted polysiloxane I*1 | 18000 | 0.025 |
| Epoxy-substituted polysiloxane II*2 | 8000 | 0.033 |
| Epoxy-substituted polysiloxane III*3 | 6000 | 0.294 |
| Epoxy-substituted polysiloxane IV*4 | 3000 | 0.026 |
| Epoxy-substituted polysiloxane V*5 | 170 | 0.140 |
| Epoxy-substituted polysiloxane VI*6 | 30 | 0.290 |
| Dimethylsilicone*7 | 12500 | — |
| Phenylglycidyl*8 | — | 0.613 |

TABLE 2-continued

| | Kinematic viscosity at 25° C. (cSt) | Epoxy value (gram equivalent/100 g) |
|---|---|---|
| ether | | |

*1 SF8413 (trade name), produced by Toray Silicone Co., Ltd.
*2 SF8411 (trade name), produced by Toray Silicone Co., Ltd.
*3 KF103 (trade name), produced by Sinetsu Chemical Industry
*4 X-22-3667 (trade name), produced by Sinetsu Chemical Industry
*5 X-60-164 (trade name), produces by Sinetsu Chemical Industry
*6 X-22-343 (trade name), produced by Sinetsu Chemical Industry
*7 KF96 (trade name), produced by Sinetsu Chemical Industry
*8 Epiol P (trade name), Nippon Oil & Fats Co., Ltd.

TABLE 3

| Items | No. | | | | | | | | | | |
|---|---|---|---|---|---|---|---|---|---|---|---|
| | Example | | | | | Comparative example | | | | | |
| | 1 | 2 | 3 | 4 | 5 | 1 | 2 | 3 | 4 | 5 | 6 |
| Composition of components (parts by weight) | | | | | | | | | | | |
| Mineral oil | 100 | 100 | 100 | 100 | — | 100 | 100 | 100 | 100 | 100 | — |
| Polyglycol ether | — | — | — | — | 100 | — | — | — | — | — | 100 |
| Epoxy-group substituted polysiloxane I | 0.01 | — | — | — | 0.01 | — | — | — | — | — | — |
| Epoxy-group substituted polysiloxane II | — | 0.01 | — | — | — | — | — | — | — | — | — |
| Epoxy-group substituted polysiloxane III | — | — | 0.01 | — | — | — | — | — | — | — | — |
| Epoxy-group substituted polysiloxane IV | — | — | — | 0.01 | — | — | — | — | — | — | — |
| Epoxy-group substituted polysiloxane V | — | — | — | — | — | — | 0.01 | — | — | — | — |
| Epoxy-group substituted polysiloxane VI | — | — | — | — | — | — | — | 0.01 | — | — | — |
| Dimethylsilicone | — | — | — | — | — | — | — | — | 0.01 | — | — |
| Phenylglycidyl ether | — | — | — | — | — | — | — | — | — | 0.01 | — |
| Test results | | | | | | | | | | | |
| Shield tube test | | | | | | | | | | | |
| Color hue | L2.0 | L2.0 | L2.0 | L2.0 | L2.0 | L8.0 | L2.0 | L2.0 | L8.0 | L2.0 | L4.0 |
| HCl formed amount* | 10 | 9 | 10 | 8 | 4 | 50 | 10 | 8 | 61 | 9 | 38 |
| Foaming test | | | | | | | | | | | |
| New oil | 10 or less-0 | 10 or less-0 | 10 or less-0 | 10 or less-0 | 10–0 | 350–0 | 340–0 | 600–100 | 10 or less-0 | 60–100 | 100–0 |
| Used oil | 10–0 | 10–0 | 10–0 | 10–0 | 10–0 | 450–0 | 580–80 | 620–100 | 10 or less-0 | 660–110 | 130–0 |

*Unit is mg.KOH/4 ml.

From the above Table 3, the following (1) to (5) can be understood.

(1) In Comparative examples 1 and 6, evaluations of the base oil alone are carried out, but shield tube test characteristics are poor and foaming is also large.

(2) Comparative examples 2 and 3 are compositions blended with a polysiloxane having an epoxy structure with a low viscosity (the kinematic viscosity at 25° C. is less than 1000 cSt), and both of the new oil and used oil resulted large foaming.

(3) Comparative example 4 is an example using dimethylsilicone which has conventionally been used as an anti-foaming agent, but is poor in shield tube test characteristics.

(4) Comparative example 5 is an example using phenylglycidyl ether which has conventionally been used as a hydrochloric acid capturing agent, but is poor with regard to foaming.

(5) Examples 1 to 5 are compositions in which the polysiloxane having an epoxy structure with high viscosity (the kinematic viscosity at 25° C. is 1000 cSt or higher) is blended to a base oil comprising a mineral oil or a synthetic oil, and they show good shield tube test characteristics and little foaming in both of new oil and used oil.

INDUSTRIAL APPLICABILITY

As explained above, the lubricating oil composition of the present invention has excellent high temperature stability and anti-foaming properties in the presence of various coolants such as Flon, etc.

Accordingly, the lubricating oil composition of the present invention can be effectively utilized as a refrigerator oil, a heat pump oil, etc.

I claim:

1. A lubricating oil composition for a Flon atmosphere comprising 100 parts by weight of a base oil having a kinematic viscosity at 40° C. of 5 to 500 cSt and 0.001 to 0.1 parts by weight of a polysiloxane having an epoxy structure, an epoxy value of 0.01 to 0.5 gram equivalent/100 g and a kinematic viscosity at 25° C. of 1000 cSt or higher; said polysiloxane being represented by the formula:

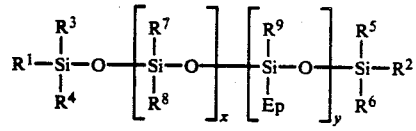

wherein $R^1$ to $R^6$ each represents an alkyl group having 1 to 20 carbon atoms, a cycloalkyl group having 6 to 30 carbon atoms, an alkylaryl group having 6 to 30 carbon atoms or an alkoxy group having 1 to 20 carbon atoms; $R^7$ and $R^8$ each represents an alkyl group having 6 to 30 carbon atoms, an alkylaryl group having 6 to 30 carbon atoms or a cycloalkyl group having 6 to 30 carbon atoms; $R^9$ represents an alkyl group having 1 to 20 carbon atoms, and alkylaryl group having 6 to 30 carbon atoms or a group having an epoxy structure; Ep represents a group having an epoxy structure; and x and y are integers satisfying $x \geqq 0$, $y > 0$ and $x + y = 50$ to 2000.

2. A lubricating oil composition for a Flon atmosphere according to claim 1, wherein the base oil is a deep dewaxed oil.

3. A lubricating oil composition for a Flon atmosphere according to claim 1, wherein Ep or said group having an epoxy structure is a group selected from the group consisting of a glycidoxymethyl group, a β-glycidoxyethyl group, a γ-glycidoxypropyl group, a δ-glycidoxybutyl group, a glycidoxyoctyl group, a β-(3,4-epoxycyclohexyl)ethyl group and a β-(3,4-epoxyphenyl)ethyl group.

4. A lubricating oil composition for a Flon atmosphere according to claim 3, wherein $R^1$ and $R^2$ each represent a methyl group; $R^3$ to $R^6$ each represent a methyl group or a methoxy group and $R^7$ to $R^9$ each represent a methyl group.

5. A lubricating oil composition for a Flon atmosphere according to claim 4, wherein $$\frac{y}{x+y} = 0.2 \text{ to } 0.50.$$

6. A lubricating oil composition for a Flon atmosphere according to claim 4, wherein $x+y=100$ to 1,000.

7. A lubricating oil composition for a Flon atmosphere according to claim 4, wherein Ep is a γ glycidoxypropyl group or a β-(3,4-epoxycyclohexyl)ethyl group.

8. A lubricating oil composition for a Flon atmosphere according to claim 4, wherein $$\frac{y}{x+y} = 0.1 \text{ to } 0.60.$$

9. A lubricating oil composition for a Flon atmosphere according to claim 4, wherein $R^3$ to $R^6$ each represent a methyl group.

* * * * *